US008149044B2

(12) United States Patent
Liao

(10) Patent No.: US 8,149,044 B2
(45) Date of Patent: Apr. 3, 2012

(54) TRIMMER CIRCUIT AND METHOD

(75) Inventor: Chia-Wei Liao, San Jose, CA (US)

(73) Assignee: Richtek Technology Corp., Hsinchu (TW)

( * ) Notice: Subject to any disclaimer, the term of this patent is extended or adjusted under 35 U.S.C. 154(b) by 189 days.

(21) Appl. No.: 12/222,933

(22) Filed: Aug. 20, 2008

(65) Prior Publication Data

US 2009/0051411 A1 Feb. 26, 2009

(30) Foreign Application Priority Data

Aug. 24, 2007 (TW) ..... 96131425 A

(51) Int. Cl.
*H01H 85/00* (2006.01)

(52) U.S. Cl. ..... 327/525; 365/96

(58) Field of Classification Search ..... 327/525
See application file for complete search history.

(56) References Cited

U.S. PATENT DOCUMENTS

| | | | | |
|---|---|---|---|---|
| 5,661,323 | A * | 8/1997 | Choi et al. | 257/378 |
| 5,712,588 | A * | 1/1998 | Choi et al. | 327/525 |
| 6,201,432 | B1 * | 3/2001 | Lim et al. | 327/525 |
| 6,400,632 | B1 * | 6/2002 | Tanizaki et al. | 365/225.7 |
| 6,703,885 | B1 * | 3/2004 | Fan et al. | 327/308 |
| 6,728,158 | B2 * | 4/2004 | Takahashi et al. | 365/225.7 |
| 7,057,441 | B2 * | 6/2006 | Yoon | 327/526 |

* cited by examiner

*Primary Examiner* — Ryan Jager
(74) *Attorney, Agent, or Firm* — Rosenberg, Klein & Lee

(57) ABSTRACT

A trimmer circuit is so configured that an electronic device will break down to produce a high current to trim a fuse. The electronic device is selectively configured to have a breakdown voltage lower than an applied voltage, for the trigger of its breakdown to be controllable. In an embodiment, the electronic device is switched between two states having two breakdown voltages respectively, and the applied voltage is higher than one of the breakdown voltages and lower than the other one.

2 Claims, 4 Drawing Sheets

TRIMMER CIRCUIT AND METHOD

FIELD OF THE INVENTION

The present invention is related generally to a trimmer circuit and method and, more particularly, to a high current trimmer circuit and method.

BACKGROUND OF THE INVENTION

In the process of fabricating integrated circuits (ICs), electrical characteristics, such as resistance and capacitance values and transistor gain, of an actual fabricated circuit usually vary from ideal values in a circuit design. The differences in electrical characteristics can result in drawbacks, such as lower operating efficiency and improper circuit operation.

Trimmer process can be conducted to adjust the electrical characteristics of an IC to meet specifications. For trimmer process, there are two approaches: chip probing (CP) method which is conducted before packaging, and final test (FT) method which is conducted after packaging. To trim electrical characteristics of an IC, several fuses are designed and fabricated in the IC. In the CP method, the fuses in the IC are selectively blown off by a current produced by applying a voltage on a probe pad, or cut off by a laser. The FT method applies a voltage to a null pin to trim the fuses in the IC. Conventional methods zap the fuses by many extra external pads. For example, with reference to FIG. 1, several resistors 12 are serially connected between a node A and a node B, each of the resistors 12 is connected in parallel with a fuse 10 of which the two terminals are each connected to one of several pads 14, and the pads 14 are selectively applied with a voltage to blow off desired one or ones of the fuses 10 to be short circuit, so as to adjust the resistance value between the nodes A and B.

The IC package will introduce offset and thereby cause the FT method and CP method to have slightly different results. Thus the FT method is better than the CP method for the adjustment of circuit characteristics. However, the most limitation of the FT method is that the trimmer process needs one or more extra pins for control, which causes the pin count to increase and waste and is thus disadvantageous to shrink the size of an IC. Especially to the IC with high pin count, the FT method is not easy to apply. U.S. Pat. No. 6,703,885 to Fan et al. is to build up a circuit which can trim fuses by only two external pads. To zap fuses, however, this trimmer method may need very high current, maybe several hundred mA, and therefore, it will cost large chip area to implement a single device even MOS or bipolar junction transistor (BJT) in normal operation to provide such trimming current.

SUMMARY OF THE INVENTION

An object of the present invention is to provide a trimmer circuit and method for an IC.

Another object of the present invention is to provide a trimmer circuit and method to implement a small area device to provide enough current to trim fuses.

Yet another object of the present invention is to provide a trimmer circuit and method to shrink the circuit size.

According to the present invention, an electronic device is used to provide a breakdown current to trim a fuse. Preferably, a current-to-voltage characteristic of the electronic device in a breakdown region is utilized such that even a small size BJT can provide enough current to trim a fuse, thereby shrinking the circuit size. Preferably, the electronic device is so configured to operate in either one of two electrical states, and in each state the electronic device has a controllable breakdown voltage.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
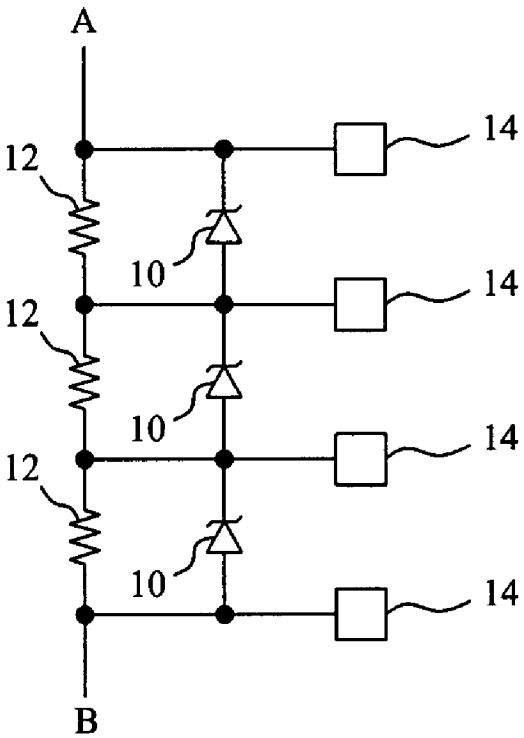
Fig. 1 Prior Art
FIG. 1 is a conventional trimmer circuit.
Figure 2:
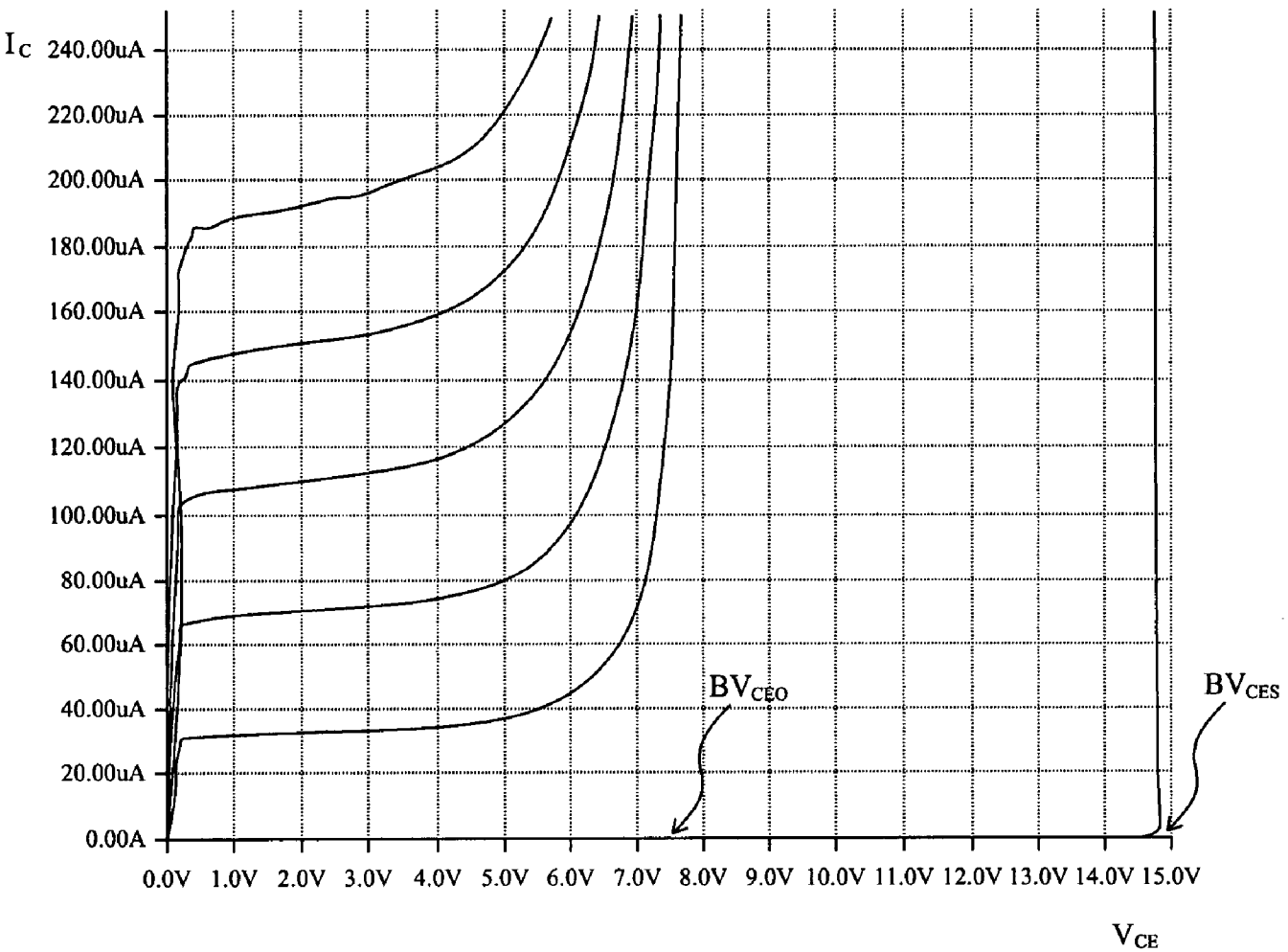
FIG. 2 is a diagram showing various current-to-voltage (I-V) curves of a BJT in a breakdown region.
Figure 3:
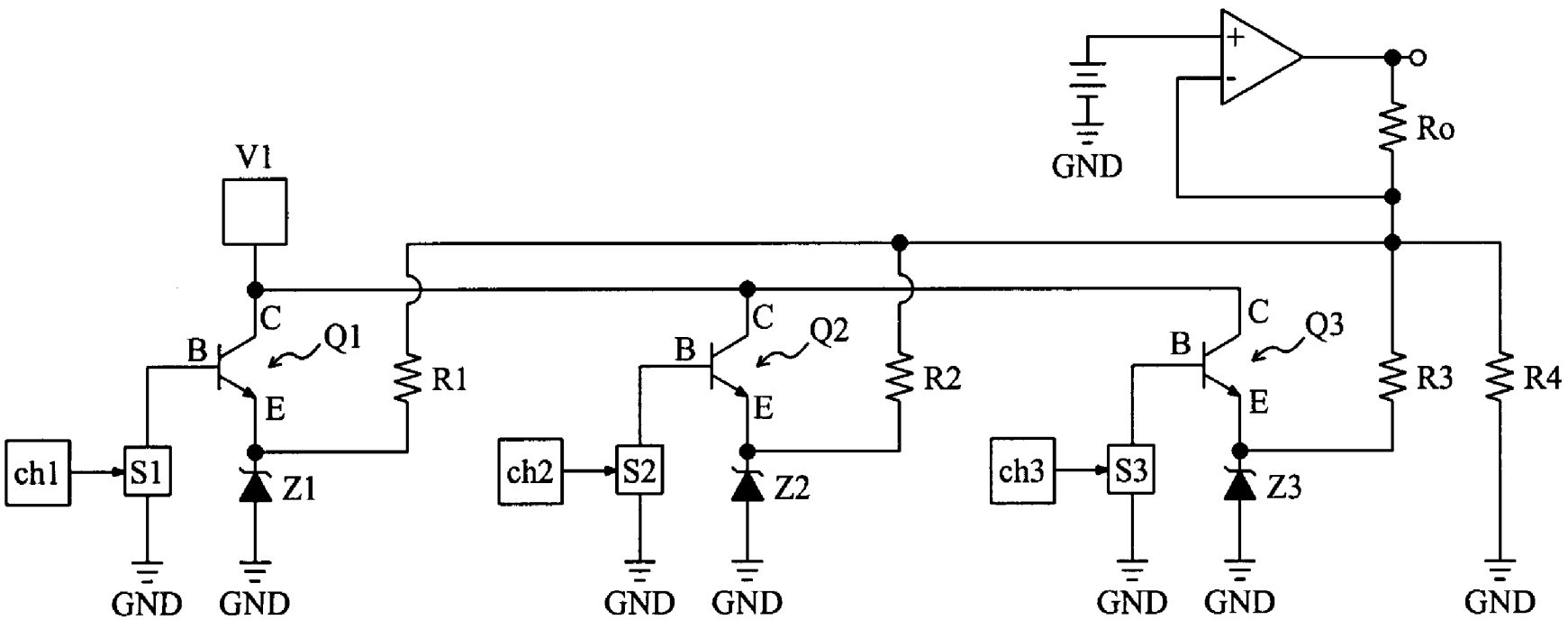
FIG. 3 is a first embodiment according to the present invention.

FIG. 3 shows an embodiment according to the present invention, in which three bipolar junction transistors (BJTs) Q1-Q3 have their collectors C connected to a voltage pad V1, and their emitters E connected to three fuses Z1-Z3 respectively. In this embodiment, each of the fuses Z1-Z3 is a Zener diode, and in other embodiments, polysilicon resistors or an erasable programmable memory (EPROMs) can be used instead for the fuses. Back to FIG. 3, the bases B of the BJTs Q1-Q3 are connected to three switches S1-S3 respectively, and each of the switches S1-S3 is a MOSFET or BJT and is controlled by one of three selecting signals ch1-ch3 to turn on or off, so as to have the bases B of the BJTs Q1-Q3 to be grounded or open circuit. In this embodiment, a characteristic of the BJTs Q1-Q3 is utilized, in which each of the BJTs Q1-Q3 have two breakdown voltages $BV_{CEO}$ and $BV_{CES}$ when its base B is grounded or open respectively, to control the currents flowing through the fuses Z1-Z3. For example, as shown in FIG. 2, if a BJT has a breakdown voltage $BV_{CES}$ of about 15V when it has a grounded base, it will have a breakdown voltage $BV_{CEO}$ of about 7.5V when it has an open base. It is well knows that BJT $BV_{CEO}$, which is the breakdown voltage as base open, is lower than $BV_{CES}$, which is the breakdown voltage as base emitter short. Therefore, by changing the base bias condition of a BJT to utilize a current-to-voltage characteristic of the BJT in a breakdown region. Further more, it may use a small size BJT in breakdown region to provide a sufficient current to blow off a fuse.

The operation of the trimmer circuit shown in FIG. 3 is now explained in detail. When the selecting signals ch1-ch3 are high, the switches S1-S3 are turned on to connect the bases B of the BJTs Q1-Q3 to ground; when the selecting signals ch1-ch3 are low, the switches S1-S3 are turned off to have the bases B of the BJTs Q1-Q3 to be open circuit. Therefore, it is to switch the switches S1-S3 by the selecting signals ch1-ch3 to configure the electrical characteristic of the BJTs Q1-Q3 between two states, so as to selectively trigger the breakdown of the BJTs Q1-Q3 by an applied voltage V1 to trim desired one or ones of the fuses Z1-Z3. For example, to trim the fuse Z3, the selecting signals ch1 and ch2 are set to be high and thereby short the bases B of the BJTs Q1 and Q2 to ground, so as to switch their breakdown voltages to $BV_{CES}$, the selecting signal ch3 is set to be low to have the base of the BJT Q3 to be open circuit, so as to switch its breakdown voltage to $BV_{CEO}$, and the applied voltage V1 is set to be higher than $BV_{CEO}$ but lower than $BV_{CES}$. As a result, the BJT Q3 will break down and thereby produce a high current to blow off the fuse Z3 to be short circuit, and the BJTs Q1 and Q2 will not break down to trim the fuses Z1 and Z2. Parallel connected resistors R3 and R4 are connected serially to a resistor Ro, and the resistance value seen from the output terminal is so determined.

Particularly, when all the selecting signals ch1-ch3 are high to short the bases B of the BJTs Q1-Q3 to ground, the BJTs Q1-Q3 do not conduct any current because the breakdown voltage $BV_{CES}$ of the BJTs Q1-Q3 is higher than the applied voltage V1, and thereby consume no power.

In this embodiment, because the BJTs Q1-Q3 are operated in a breakdown region, it only needs a very small chip area to provide a high current, and the switch transistors S1-S3 don't need big size to sustain high current. Especially in the case of having a great number of fuses, it can save significant chip area.

Alternatively, it may configure the switches S1-S3 to connect the bases B of the BJTs Q1-Q3 to a non-zero voltage instead of leaving them to be open circuit, which can still set the breakdown voltage of the BJT Q1-Q3 to be $BV_{CEO}$.

In this embodiment, each of the BJTs Q1-Q3 is of an NPN type. In other embodiments, PNP BJTs can be used instead.

Figure 4:
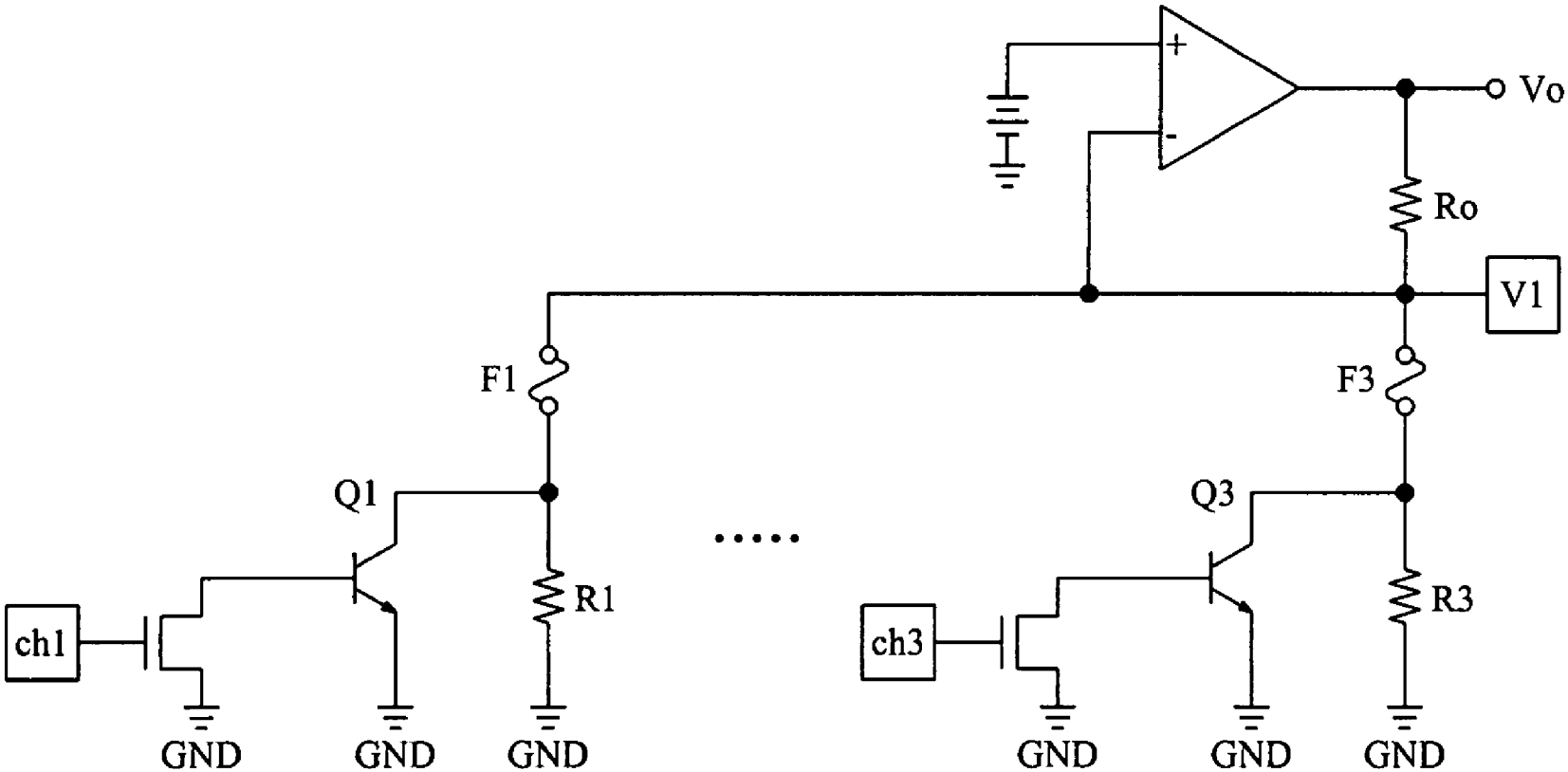
FIG. 4 is a second embodiment according to the present invention.

FIG. 4 shows another embodiment according to the present invention, in which the selecting signal ch1 is set to be high to short the base of the BJT Q1 to ground, thereby setting its breakdown voltage to $BV_{CES}$, the selecting signal ch3 is set to be low to leave the base of the BJT Q3 to be open circuit, thereby setting its breakdown voltage to $BV_{CEO}$, and the applied voltage V1 is set to be higher than $BV_{CEO}$ but lower than $BV_{CES}$, such that the BJT Q3 will break down to provide a high current to blow off the fuse F3 to be open circuit, so as to adjust the resistance value seen from the output terminal to be R1+Ro from original (R1//R3)+Ro.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A trimmer method for selectively trimming a fuse, comprising the steps of:

establishing an operational mode of a bipolar junction transistor by selectively setting a base of the bipolar junction transistor to be grounded or open circuit;

triggering a breakdown region in the bipolar junction transistor having the base set to be open circuit to produce a current; and supplying the current to the fuse to trim the fuse.

2. The trimmer method of claim 1, wherein the step of triggering a breakdown region in the bipolar junction transistor having the base set to be open circuit to produce a current comprises the steps of:

configuring the bipolar junction transistor to have a first breakdown voltage or a second breakdown voltage higher than the first breakdown voltage based on the operational mode, wherein the bipolar junction transistor has the first breakdown voltage if the base is open circuit, and has the second breakdown voltage if the base is grounded; and applying a voltage higher than the first breakdown voltage and lower than the second breakdown voltage to cause the breakdown of the bipolar junction transistor having the base set to be open circuit.

* * * * *